US012318889B2

(12) United States Patent
Averill

(10) Patent No.: US 12,318,889 B2
(45) Date of Patent: Jun. 3, 2025

(54) RADIAL GRINDING WHEEL FOR MACHINING CENTER HAVING IMPELLER FOR DIRECTING THROUGH-SPINDLE COOLANT TO THE WORK SURFACE OF THE TOOL

(71) Applicant: Moeller Mfg. Company, LLC, Wixom, MI (US)

(72) Inventor: Caleb Averill, Harbor Springs, MI (US)

(73) Assignee: Moeller Mfg. Company, LLC, Wixom, MI (US)

( * ) Notice: Subject to any disclaimer, the term of this patent is extended or adjusted under 35 U.S.C. 154(b) by 581 days.

(21) Appl. No.: 17/591,015

(22) Filed: Feb. 2, 2022

(65) Prior Publication Data

US 2023/0076230 A1 Mar. 9, 2023

Related U.S. Application Data

(60) Provisional application No. 63/242,099, filed on Sep. 9, 2021.

(51) Int. Cl.
*B24D 5/10* (2006.01)
*B24D 3/14* (2006.01)
*B24D 5/02* (2006.01)

(52) U.S. Cl.
CPC ..... *B24D 5/10* (2013.01); *B24D 3/14* (2013.01); *B24D 5/02* (2013.01)

(58) Field of Classification Search
CPC ... B24D 5/02; B24D 5/10; B24D 3/14; B24D 7/02; B24D 7/06; B24D 7/10; B24D 7/18; B24D 2201/00; B24B 7/10; B24B 7/186; B24B 7/228; B24B 37/12; B24B 37/16;

(Continued)

(56) References Cited

U.S. PATENT DOCUMENTS 2,733,562 A * 2/1956 Drummond ..... B24B 55/02 451/450
3,243,922 A * 4/1966 Highberg ..... B24D 7/06 451/260
4,102,084 A 7/1978 Bloomquist
(Continued)

FOREIGN PATENT DOCUMENTS

WO WO-2021037055 A1 * 3/2021 ..... B24B 55/03

OTHER PUBLICATIONS

WO2021037055—Machine Translation (Year: 2021).*

*Primary Examiner* — Brian D Keller
*Assistant Examiner* — Alberto Saenz
(74) *Attorney, Agent, or Firm* — Harness, Dickey & Pierce, P.L.C.

(57) ABSTRACT

A radial grinding tool for a machining center utilizing through-spindle coolant is disclosed and includes a main body having a central longitudinal axis, a spindle extending along the central longitudinal axis, a disc-shaped wheel member located at an end of the spindle and including a working surface at a periphery of the wheel member, and a passageway extending through the main body configured to accommodate a flow of coolant. The tool includes an impeller attached at a lower side of the wheel member and having a plurality of blades that are configured to impart a force against the coolant to reshape the flow of coolant into a generally flat stream and redirect and drive the coolant radially outward from the central longitudinal axis to the working surface.

26 Claims, 4 Drawing Sheets

(58) Field of Classification Search
CPC ..... B24B 53/017; B24B 53/12; B24B 53/095; B24B 53/14; B24B 55/02; B24B 55/03
USPC ..... 451/41, 53, 56, 63, 259, 278, 287, 353, 451/359, 449, 450, 488, 548
See application file for complete search history.

(56) References Cited

U.S. PATENT DOCUMENTS

| | | | | |
|---|---|---|---|---|
| 4,129,966 | A | 12/1978 | Smart et al. | |
| 4,216,630 | A | 8/1980 | Smart et al. | |
| 4,622,780 | A | 11/1986 | Tingley | |
| 4,709,513 | A | 12/1987 | Tingley | |
| 5,259,148 | A | 11/1993 | Wiand | |
| 5,423,717 | A * | 6/1995 | Boaz | B24B 9/10 451/449 |
| 5,607,341 | A | 3/1997 | Leach | |
| 5,702,290 | A | 12/1997 | Leach | |
| 5,733,175 | A | 3/1998 | Leach | |
| 5,836,807 | A | 11/1998 | Leach | |
| 5,839,948 | A | 11/1998 | Kronberg | |
| 7,311,588 | B1 | 12/2007 | Lin | |

* cited by examiner

RADIAL GRINDING WHEEL FOR MACHINING CENTER HAVING IMPELLER FOR DIRECTING THROUGH-SPINDLE COOLANT TO THE WORK SURFACE OF THE TOOL

CROSS-REFERENCE TO RELATED APPLICATIONS

This Application claims the benefit of U.S. Provisional Application 63/242,099 filed on Sep. 9, 2021.

FIELD

The present disclosure relates to machines and work tools that employ through-spindle coolant (TSC) and, more particularly, to a grinding wheel for a machining center that can direct coolant to a working surface of the tool.

BACKGROUND

This section provides background information related to the present disclosure which is not necessarily prior art.

Through-spindle coolant (TSC) systems for material removal devices and/or cutting machines and their work tools are well-known. TSC systems supply machines and their work tools with high pressure coolant that flows through the tool to the work surface of the tool where it engages a work piece. TSC systems enable material removal devices and/or cutting machines and tools to make more substantial material removal cuts, employ higher feed rates, allow deep-hole drilling and provide improved surface finishing.

SUMMARY

This section provides a general summary of the disclosure, and is not a comprehensive disclosure of its full scope or all of its features.

In one aspect, the present disclosure provides a radial grinding wheel suitable for use in a machining center employing through-spindle coolant. The grinding wheel includes an impeller that is operable to redirect the coolant radially outwardly from the centrally-located spindle of the tool to the working surface of the tool. More particularly, the impeller acts on an axial or columnar flow of coolant delivered through a passageway extending through the spindle of the grinding wheel. The impeller includes a plurality of blades that rotate about a central longitudinal axis of the grinding wheel and impart a force substantially normal to the central longitudinal axis on the column of coolant as they rotate. The impeller blades reshape the flow of coolant into a generally flat stream and redirect and drive the coolant stream under velocity radially outwardly from the central longitudinal axis to the working surface located near an outer periphery of a wheel member of the tool.

In another aspect of the disclosure, the grinding wheel includes a main body having a spindle and a wheel member. The impeller is removably fastened to the main body. As such, the impeller can be removed from the main body of one grinding wheel and reattached to the main body of another grinding wheel.

Accordingly, the grinding wheel of the present disclosure ensures that a steady supply of coolant from the TSC system is applied at and near the working surface of the tool and a work piece. The grinding wheel of the present disclosure improves the wear characteristics of the tool. In addition, the grinding wheel improves a surface finish of a work piece being operated on by the grinding machine. Further, the grinding tool of the present disclosure is able to grind axial surfaces both substantially parallel and substantially normal to the central longitudinal axis of the grinding wheel.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
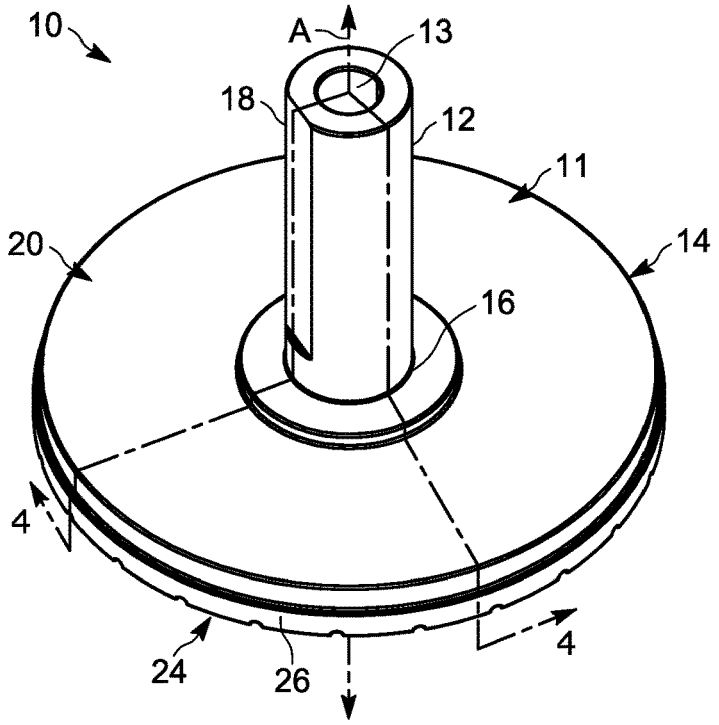
FIG. 1 shows an isometric view showing an upper side of a grinding wheel according to the present disclosure.
Figure 2:
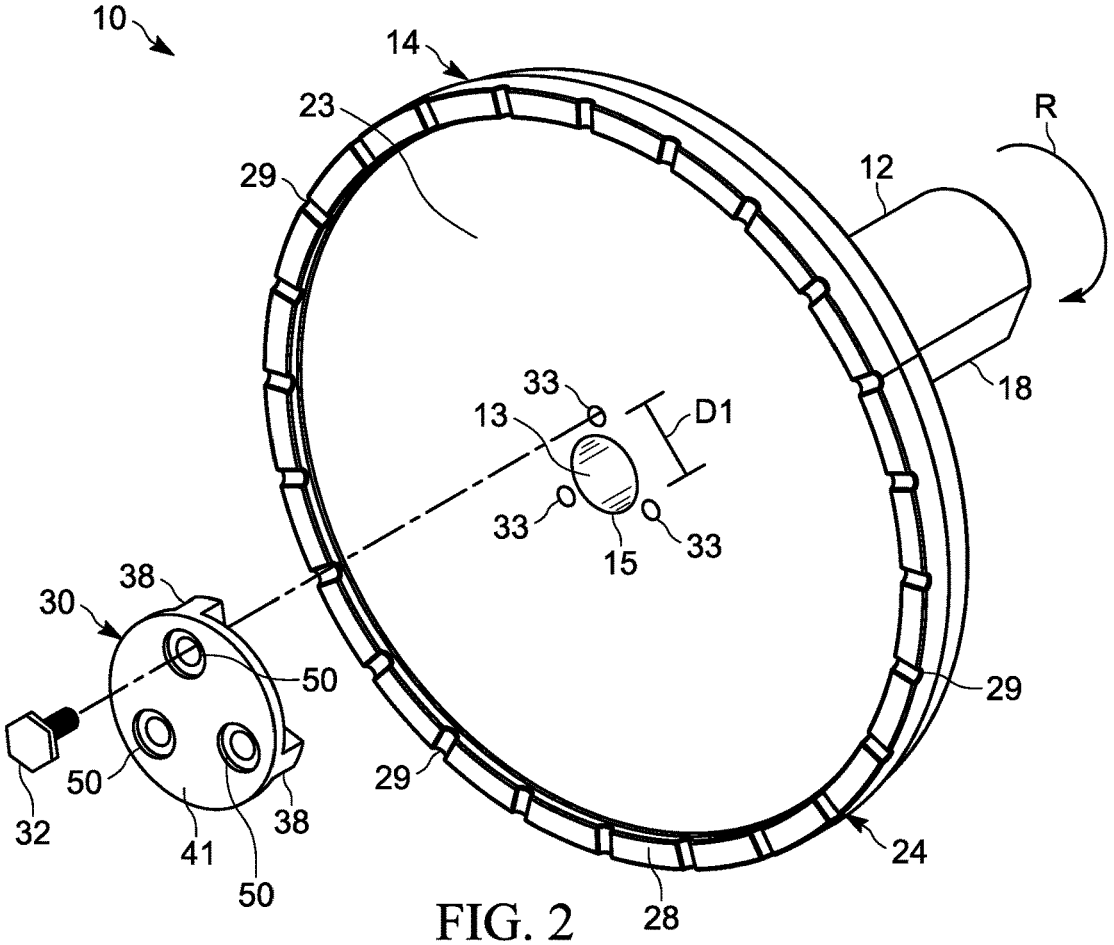
FIG. 2 is an exploded isometric view showing a lower side of the grinding wheel of FIG. 1 and, inter alia, the working surface and an impeller of the grinding wheel.

As illustrated in the figures and discussed below, the application describes a grinding wheel for a machining center that utilizes through-spindle coolant (TSC). In one exemplary embodiment, the figures show a radial TSC grinding wheel or tool 10 suitable for use in an machining center (not shown). Referring to FIGS. 1 and 2, the grinding wheel 10 generally includes a main body 11 having a spindle 12 and a wheel member 14. In addition, an impeller 30 attached to the main body 11 at a lower side of the main body 11. The spindle 12 and wheel member 14 are preferably made from steel, and the impeller 30 may be made from either steel or aluminum.

The grinding wheel 10 is symmetrical about a central longitudinal axis A and, when in use in a machining center, is rotatable about its central longitudinal axis A (arrow R). The grinding wheel 10, being configured for use in a machining center having a TSC system, includes a longitudinal channel or passageway 13 extending through the spindle 12 and wheel member 14 of the main body 11 along the central longitudinal axis A of the tool 10 and terminating at an opening 15.

Figure 4:
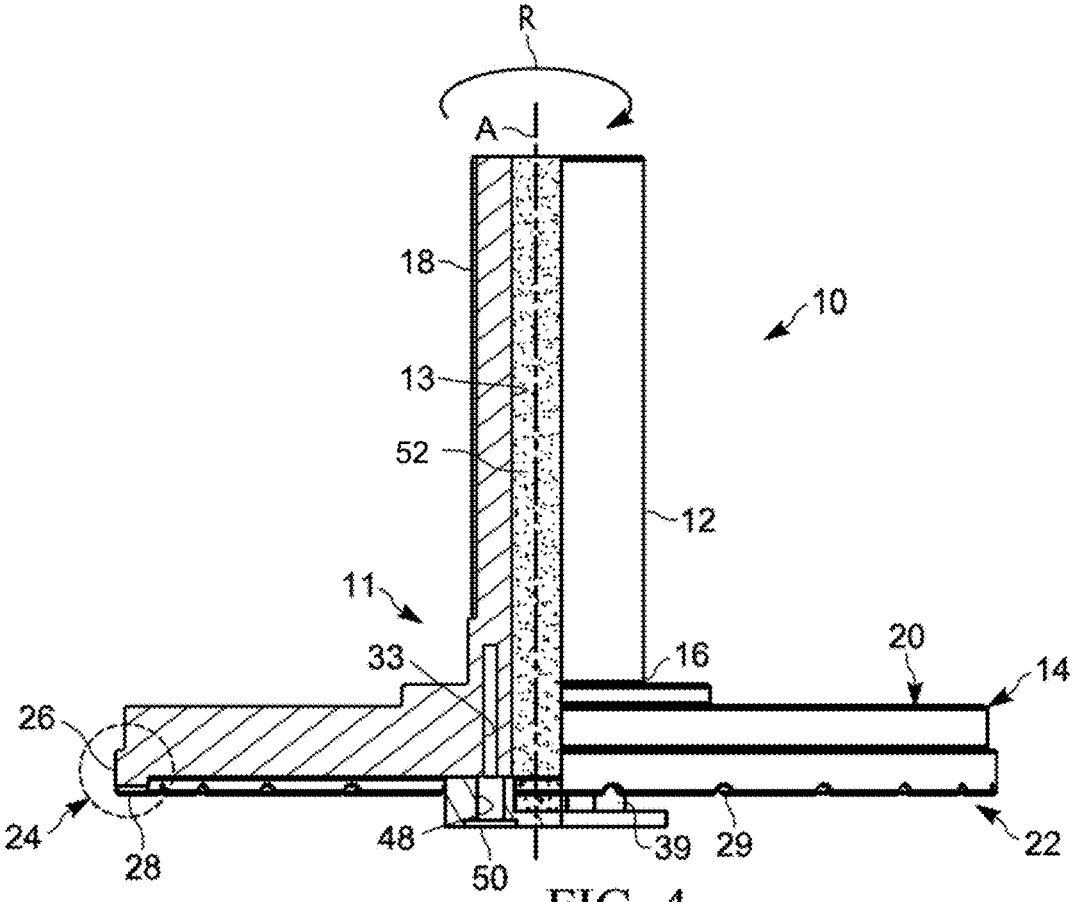
FIG. 4 is a partial cross-sectional view of the grinding wheel of FIG. 1, along the section line 4-4 of FIG. 1.

The spindle 12 is a generally cylindrically-shaped shaft having a length extending along the central longitudinal axis A. Further, as is well-known, the spindle 12 is configured to be detachably received or installed (e.g., clamped) into a mounting fixture (e.g., a chuck) of the rotary grinding machine to facilitate use the grinding wheel 10 in the grinding machine. To this end, the spindle can also incorporate a taper along its length and/or a planar mounting surface or "flat" 18. The wheel member 14 is located at a lower end 16 of the spindle 12. With reference to FIGS. 2 and 4, the wheel member 14 generally comprises a disc shape and has an upper side 20 that is located nearer to or adjacent to the lower end 16 of the spindle 12 and a lower side 22 that is opposite to and separated from the upper side 20. As best seen in FIG. 4, the passageway 13 extends through the spindle 12 and the wheel member 14.

The lower side 22 of the wheel member 14 includes a working surface 24 of the grinding wheel 10 that is configured to engage a work piece operated on by the grinding machine. The working surface 24 is located about a perimeter of the lower side 22 of the wheel member 14. The working surface 24 can include one or both of an outer circumferential surface 26 and a lower planar surface 28 of the wheel member 14. An abrasive, grit or grain can be applied to coat and/or cover the working surface 24 for grinding and/or removing material from the work piece. In an exemplary form, the working surface can be plated with cubic boron nitride (CBN) for use as an abrasive. Additionally, the working surface 24 can include one or more semi-circular apertures or grooves 29. In an exemplary embodiment, a plurality of grooves 29 are equally spaced around the perimeter of the lower side 22 of the wheel member 14, as best seen in FIG. 2.

The spindle 12 and the wheel member 14 of the grinding wheel 10 can be integrally formed as a unitary structure, such as shown in FIG. 4. In such case, the passageway 13 is a single continuous channel extending through the main body 11, as previously described. Alternatively, the spindle 12 and wheel member 14 can be separate components of an assembly forming the main body 11 of the grinding wheel 10. In such a configuration, each of the spindle 12 and the wheel member 14 can include a corresponding passageway which align with one another when assembled.

As best seen in FIGS. 2 and 4, the grinding wheel 10 also incorporates an impeller 30. The impeller 30 is attached, such as by fasteners 32, to the main body 11 at the lower side 22 of the wheel member 14. In this regard, in a preferred arrangement as best understood with reference to FIGS. 2 and 4, a plurality of threaded fasteners pass through the impeller 30 and engage corresponding receiving threaded apertures 33 in the main body 11 to affix the impeller 30 at the lower side 22 of the wheel member 14.

As further described below, the impeller 30 is operable to redirect and divert coolant flowing through the passageway 13 radially outwardly from the central longitudinal axis A of the grinding wheel 10 to the working surface 24 at the perimeter of the wheel member 14 of the grinding wheel 10. More particularly, the impeller 30 acts on the axial column of coolant delivered through the passageway 13 of the spindle 12 of the grinding wheel 10 and reshapes the column of coolant as it exits the opening 15 into a generally flat coolant stream and diverts and drives the coolant stream under force radially outward toward the perimeter of the wheel member 14 and to the working surface 24 of the tool 10.

Turning to FIGS. 2, 3A, 3B and 3C, the impeller 30 is illustrated in greater detail. As shown, the impeller 30 includes a circular base plate 34 having a generally planar upper side or face 36 and a generally planar lower side or face 41. On the upper side 36 of the base plate 34, the impeller 30 includes a plurality of vanes or blades 38 protruding generally perpendicularly from the upper side 36 (i.e., parallel to the central longitudinal axis).

Figure 3A:
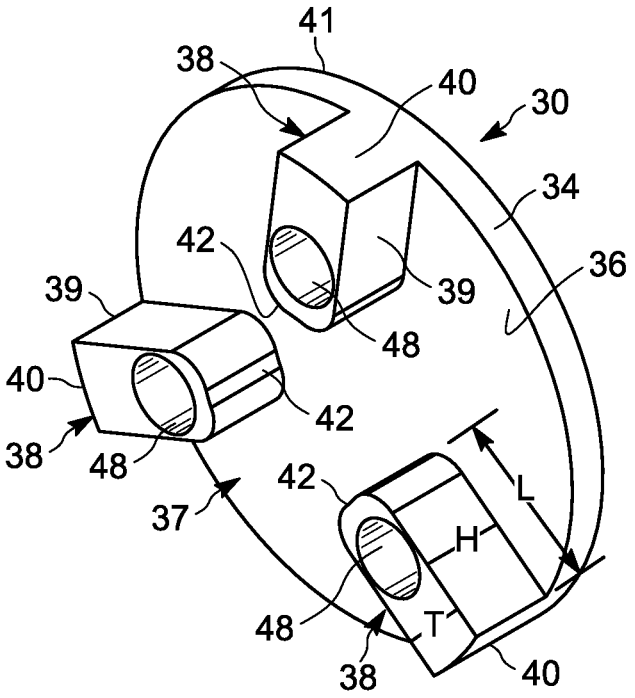
FIG. 3A is an isometric view showing an inner, upper side of the impeller of FIG. 2.
Figure 3B:
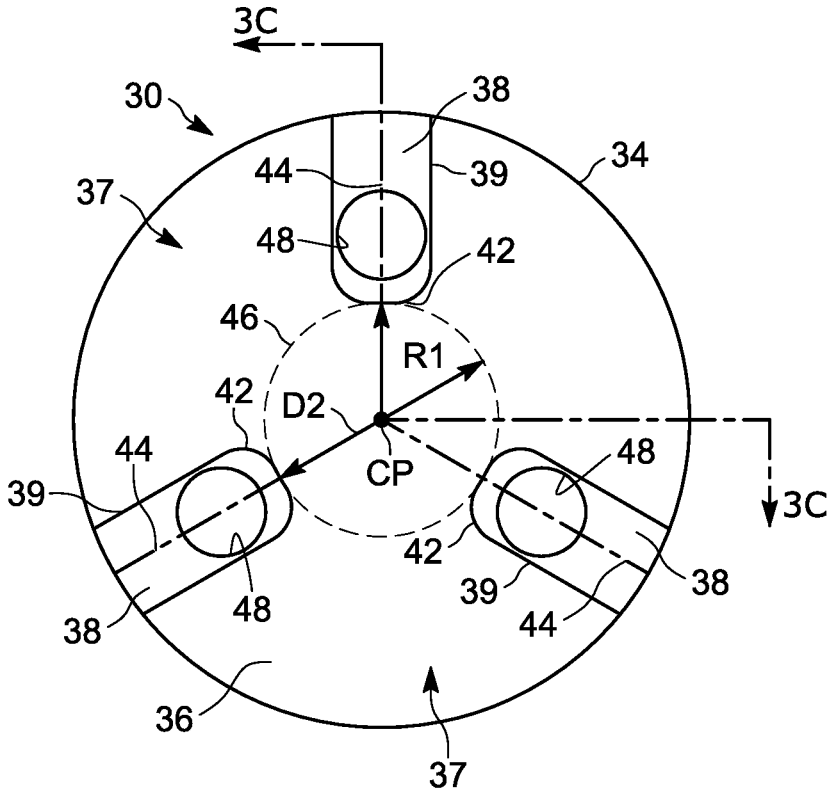
FIG. 3B is a front view of the impeller of shown in FIG. 3A.
Figure 3C:
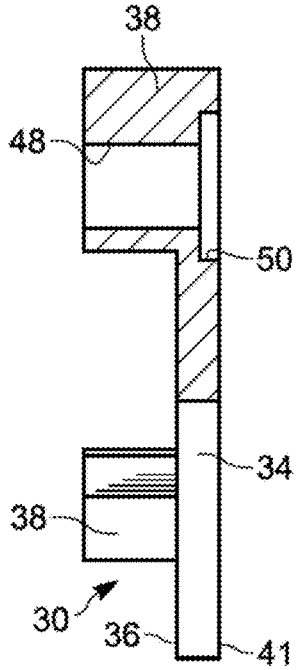
FIG. 3C is a right side view of the impeller shown in FIG. 3A, in partial cross-section along the section line 3C-3C of FIG. 3B.

As best shown in FIGS. 3A, 3B and 3C, in the exemplary embodiment, each blade 38 has a height H, a width (or thickness) W and a length L, and extends along its length L from a proximal end 40 to a distal end 42. In a preferred configuration, the distal end 42 of each blade 38 is rounded or radiused. The length L and height H geometry of the blade 38 defines a substantially planar, rectangular-shaped functional surface 39 of the blade 38 that is perpendicular to the upper side 36 of the base plate 34. Alternatively, the blades 38 can be configured so that the functional surfaces 39 can be oriented at an angle that is less than ninety degrees to the upper side 36 of the base plate 34 (i.e., non-parallel to the central longitudinal axis). In such a configuration, the functional surfaces 39 can be pitched relative to the upper surface 36. Further, the blades 38 can be configured such that the functional surfaces 39 are non-planar (e.g., are curved, spiraled, concave, etc.).

Each blade 38 is oriented on the face 36 so that its proximal end 40 is located at or proximate a perimeter of the base plate 34 and its distal end 42 extends inwardly toward a center of the face 36. The blades 38 are preferably symmetrically and/or radially positioned about the face 36 in equally spaced locations on the base plate 34, thereby creating openings or gaps 37 separating the blades 38. As such, in a preferred arrangement, a longitudinal centerline 44 of each blade 38 is perpendicular to the perimeter of the base plate 34 and intersects the longitudinal centerline 44 of each other blade 38 at a center point CP of the face 36, as shown in FIG. 3B, which lies on the central longitudinal axis A of the grinding wheel 10. Alternatively, the impeller 30 vanes or blades 38 can be oriented on the face 36 of the base plate 34 such that their centerlines 44 are less than ninety degrees to the perimeter of the base plate 34 (i.e., the centerlines 44 are not perpendicular to the perimeter of the base plate 34). In such a configuration, each of the vanes 38 would be inclined in the same direction on the face 36 of the base plate 34.

Also, as shown in FIG. 3B, the distal ends 42 of the blades 38 are equidistant from the center point CP by a radius R1 extending from the center point CP to the distal ends 42 of the blades 38. Accordingly, a central region of the impeller 30 is preferably defined by a circle 46 having a diameter D2 that is approximately equal to the diameter D1 of the opening 15 of the passageway 13.

The impeller 30 includes an opening or aperture 48 passing through the impeller 30 and sized to enable a fastener 32, such as a bolt or machine screw, to be employed to securely fasten or attach the impeller 30 to the main body 11 of a grinding wheel 10. As shown in a preferred embodiment of FIG. 2, for example, three apertures 48 are provided, with an aperture 48 passing through each of the blades 38 and the base plate 34 of the impeller 30. The apertures 48 can have corresponding countersinks or counterbores 50 in the lower side 38 of the base plate 34 to accommodate the heads of the fasteners 32. As can be appreciated, the impeller 30 can be removed from the main body 11 of one grinding wheel 10 and reattached to the main body 11 of another grinding wheel 10, such as between grinding wheels 10 having different abrasive properties or when a grinding wheel exhausts its useful life.

Figure 5:
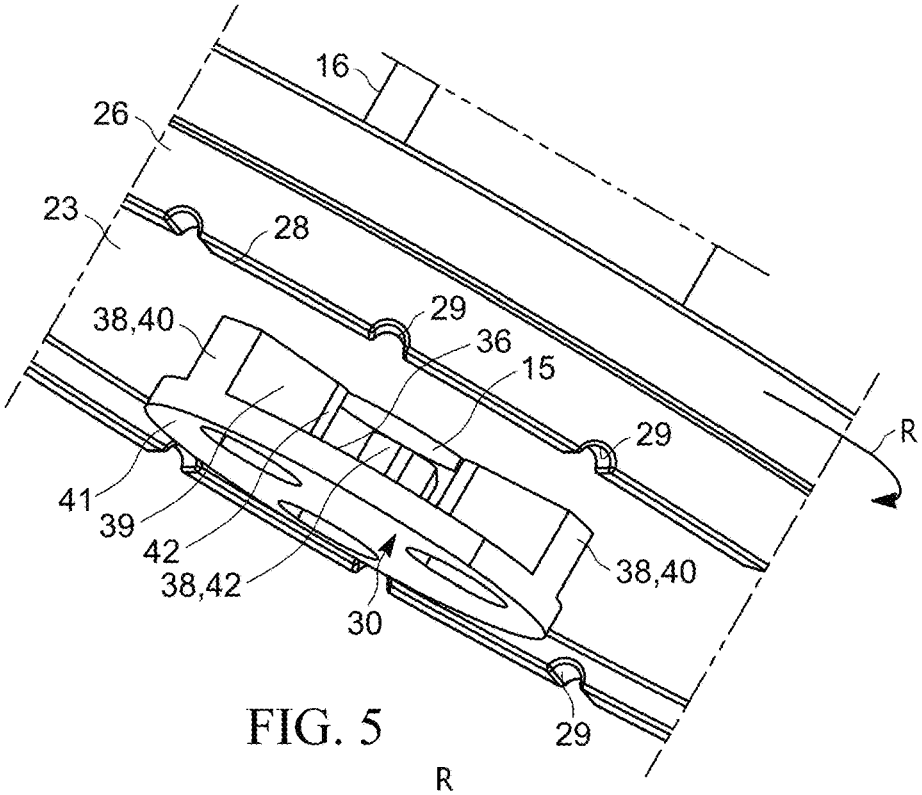
FIG. 5 is an enlarged, partial detail view of a portion of a lower side of the grinding wheel of FIG. 1.

As illustrated in FIGS. 4 and 5, the upper sides of the blades 38 abut directly against a surface 23 of the lower side 22 of the wheel member 14. When the impeller 30 is attached to the main body 11, the impeller 30 is positioned vertically below the lower side 22 of the wheel member 14.

In particular, in a preferred form illustrated in the figures, the upper side 36 of the base plate 34 is set off a distance V (as measured along the axis A) vertically below the working surface 24 of the grinding wheel 10. Correspondingly, then, the upper side 36 of the base plate 34 is vertically spaced a distance V1 (also measured along the axis A) from the opening 15 of the passageway 13 in the surface 23 of the wheel member 14, as best seen in FIG. 5. Further, as best understood from FIGS. 4 and 5, at least a portion of the functional surfaces 39 of the blades 38 likewise extend a distance V vertically below the working surface 24 of the grinding wheel 10.

Figure 6:
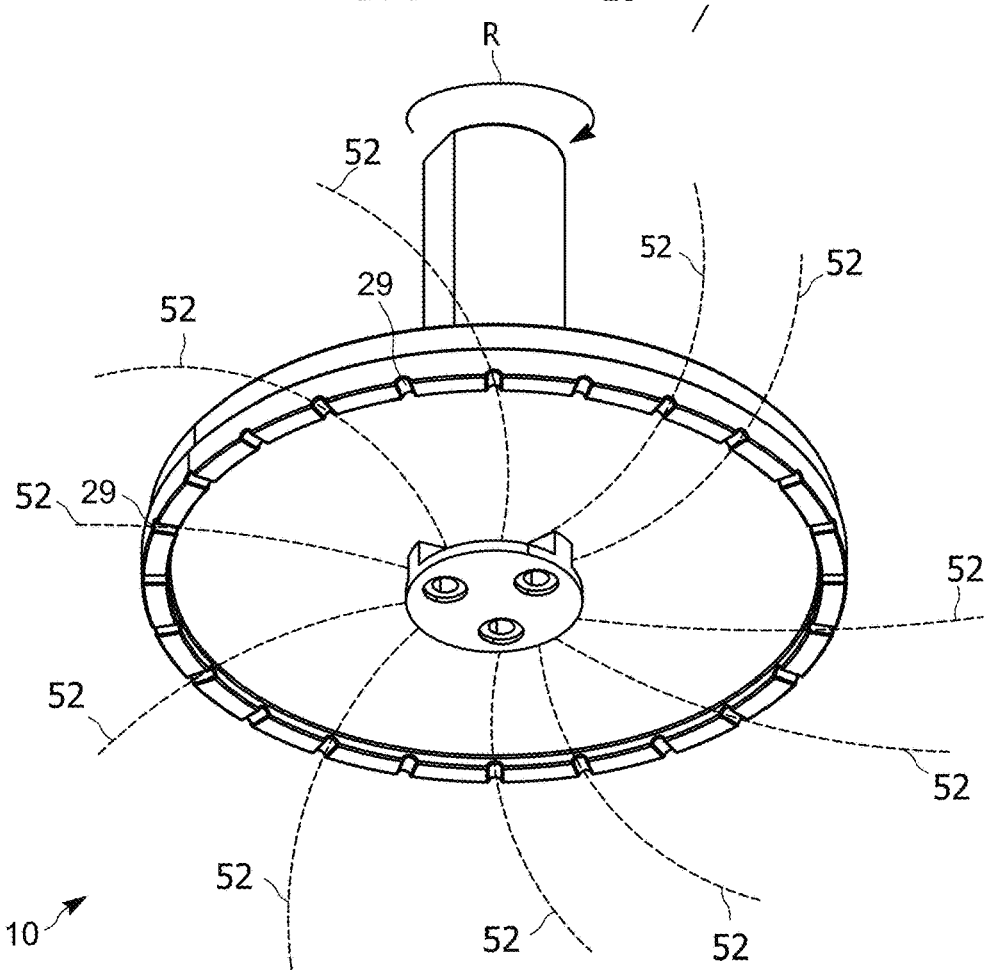
FIG. 6 is a perspective view showing lower side of a grinding tool of the present disclosure.

The function and operation of the grinding wheel 10 of the disclosure in a TSC-equipped grinding machine can be understood with reference to the figures and, in particular, FIGS. 5 and 6. In the exemplary embodiment, only a portion or segment of the working surface 24 of the grinding wheel 10 (located at the periphery of the wheel member 14) engages a work piece at any time during the grinding process and the remainder of the lower side 22 of the wheel member 14 is generally spaced from the work piece. Put another way, the grinding wheel 10 does not cooperate with the work piece to enclose a volume during the grinding process, such as may occur with a surface grinding wheel.

As is well understood, the grinding wheel 10 is mounted via the spindle 12 to a TSC-equipped machining center. During a grinding operation, the grinding wheel 10 is driven to rotate at high speed, which can vary based upon several factors including the diameter of the wheel member 14, the material of the work piece, and surface finish requirements. For example, rotational speeds of between 3500 rpm and 4500 rpm are not uncommon. Also, the TSC system supplies a flow of coolant 52 under pressure through the passageway 13 of the spindle 12 of the grinding wheel 10. Upon exiting the passageway 13 at the opening 15 the coolant 52 generally has in the form of a column with a diameter substantially the same as D1.

After exiting the passageway 13, the column of coolant 52 continues on a linear trajectory along axis A until it impacts the base plate 34 of the impeller 30. At the base plate 34, the columnar flow of coolant "mushrooms" and expands outwardly in all directions generally perpendicular to the longitudinal axis A. In doing so, the coolant 52 expands into the gaps 37 separating the blades 38 of the impeller 30. There, the functional surfaces 39 of the rotating blades 38 of the impeller 30 act on the coolant 52 to impart a force normal to or substantially normal to the longitudinal axis A. The functional surfaces 39 of the rotating blades 38 reshape the flow of coolant 52 into a generally flat stream and redirect and drive the coolant stream with velocity radially outward to the working surface 24 at the perimeter of the wheel member 14 of the tool 10. In this respect, the blades 38 of the impeller 30 are operable to impart a force directly against the coolant 52 that is sufficient to drive the coolant 52 radially outward at a velocity to enable the coolant 52 to reach the working surface 24 of the tool 10 and the work piece.

As best seen in FIG. 6, the coolant 52 can escape from the tool 10 past the working surface 24 through the grooves 29 spaced around the perimeter of the lower side 22 of the wheel member 14. In addition to providing for heat transfer at the working surface 24 and work piece, the coolant 52 carries away material (e.g., grindings or chips) removed from the work piece as it escapes through the grooves 29.

The grinding wheel 10 according to the present disclosure provides significant improvements to the operating life of the grinding wheel extending it on the order of fifty percent (50%). Additionally, the grinding wheel produces improved surface finishes on the work piece.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A grinding tool for a machining center comprising a through-spindle coolant (TSC) system, the grinding tool comprising:

a main body comprising a central longitudinal axis, a spindle extending along the central longitudinal axis and having an end, a disc-shaped wheel member located at the end of the spindle and comprising an upper side adjacent to the end of the spindle, a lower side opposite to the upper side and a working surface located at a periphery of the disc-shaped wheel member, and a passageway extending through the main body terminating at an opening on the lower side of the disc-shaped wheel member and configured to accommodate a flow of coolant from the TSC system therethrough; and an impeller attached to the main body at the lower side of the disc-shaped wheel member, the impeller comprising a plurality of blades symmetrically positioned about the central longitudinal axis, each blade of the plurality of blades comprising a functional surface configured to impart a force substantially normal to the central longitudinal axis on the coolant exiting the passageway at the opening, at least a portion of the functional surface extending a distance vertically below the working surface of the disc-shaped wheel member.

2. The grinding tool of claim 1, wherein the impeller further comprises a circular base plate comprising a generally planar upper face, wherein the plurality of blades protrude generally perpendicularly from the generally planar upper face.

3. The grinding tool of claim 2, wherein the main body and the impeller are each symmetrical about the central longitudinal axis.

4. The grinding tool of claim 3, wherein each blade of the plurality of blades extends along a length from a proximal end to a distal end;

wherein the distal end is radiused; and wherein the functional surface of each blade of the plurality of blades is substantially rectangular-shaped.

5. The grinding tool of claim 2, wherein a longitudinal centerline of each blade of the plurality of blades intersects at a center point of the generally planar upper face of the circular base plate;

wherein the center point lies on the central longitudinal axis.

6. The grinding tool of claim 5, wherein each blade of the plurality of blades is spaced apart radially equidistant from one another about the face on the circular base plate.

7. The grinding tool of claim 2, wherein each blade of the plurality of blades extends along a length from a proximal end to a distal end; and wherein each blade of the plurality of blades is oriented on the generally planar upper face of the circular base plate of the impeller so that the proximal end is located at a perimeter of the circular base plate and the distal end extends inwardly toward the central longitudinal axis.

8. The grinding tool of claim 7, wherein each blade of the plurality of blades is spaced apart radially equidistant from one another about the face on the base plate.

9. The grinding tool of claim 8, wherein the distal end of each blade of the plurality of blades is equidistant from the central longitudinal axis.

10. The grinding tool of claim 9, wherein a central region of the impeller is defined by a circle that is tangent to the distal ends of the plurality of blades, the circle having a first diameter that is approximately equal to a second diameter of the opening of the passageway.

11. The grinding tool of claim 1, wherein each blade of the plurality of blades extends along a length from a proximal end to a distal end; and wherein a central region of the impeller is defined by a circle that is tangent to the distal ends of the plurality of blades, the circle having a first diameter that is approximately equal to a second diameter of the opening of the passageway.

12. The grinding tool of claim 11, wherein the impeller comprises at least one aperture extending through the impeller;

wherein the main body comprises at least one female threaded aperture;

wherein the impeller is removably fastened to the main body by a threaded fastener passing through the at least one aperture in the impeller and received in the at least one female threaded aperture.

13. The grinding tool of claim 12, wherein the at least one aperture extending through the impeller comprises an aperture extending through the distal end of at least one blade of the impeller.

14. The grinding tool of claim 13, wherein the working surface comprises a plurality of apertures spaced about a perimeter of the lower side of the disc-shaped wheel member.

15. The grinding tool of claim 1, wherein the working surface comprises cubic boron nitride.

16. The grinding tool according to claim 1, wherein the functional surface of each blade of the plurality of blades is configured to reshape the coolant into a generally flat stream while redirecting and driving the coolant radially outward to the working surface.

17. A radial grinding tool for a machining center comprising a through-spindle coolant (TSC) system, the radial grinding tool comprising:

a main body comprising a central longitudinal axis, a spindle extending along the central longitudinal axis and having an end, a disc-shaped wheel member located at the end of the spindle and comprising an upper side adjacent to the end of the spindle, a lower side opposite to the upper side and a working surface, and a passageway extending through the main body terminating at an opening on the lower side of the disc-shaped wheel member and configured to accommodate coolant flowing from the TSC system along the central longitudinal axis; and an impeller attached to the main body at the lower side of the disc-shaped wheel member, the impeller comprising a plurality of vanes positioned radially about the central longitudinal axis, each vane of the plurality of vanes comprising a functional surface configured to impart a force on the coolant exiting the opening of the passageway;

wherein the working surface is located at an outer periphery of the disc-shaped wheel member and comprises an outer circumferential surface of the disc-shaped wheel member; and wherein at least a portion of the functional surface is located vertically lower than the working surface of the disc-shaped wheel member as measured in a direction along the central longitudinal axis.

18. The radial grinding tool of claim 17, wherein the working surface further comprises a lower planar surface of the disc-shaped wheel member.

19. The radial grinding tool of claim 18, wherein the functional surface of each vane of the plurality of vanes is parallel to the central longitudinal axis.

20. The radial grinding tool of claim 19, wherein the functional surface of each vane of the plurality of vanes is planar.

21. The radial grinding tool of claim 18, wherein the functional surface of each vane of the plurality of vanes is non-parallel to the central longitudinal axis.

22. The radial grinding tool of claim 21, wherein the functional surface of each vane of the plurality of vanes is non-planar.

23. The radial grinding tool of claim 18, wherein the impeller includes a circular base plate, a centerline of each vane of the plurality of vanes is perpendicular to a perimeter of the circular base plate; and wherein the functional surface of each vane of the plurality of vanes is planar.

24. The radial grinding tool of claim 18, wherein the impeller includes a circular base plate;

wherein a centerline of each of the plurality of vanes is non-perpendicular to a perimeter of the circular base plate; and wherein each centerline of each of the plurality of vanes is angled relative to the perimeter of the circular base plate in the same direction.

25. The radial grinding tool of claim 24, wherein the functional surface of each of the plurality of vanes is planar.

26. The radial grinding tool of claim 24, wherein the functional surface of each of the plurality of vanes is non-planar.

* * * * *